US006626201B1

(12) United States Patent
Kim

(10) Patent No.: US 6,626,201 B1
(45) Date of Patent: Sep. 30, 2003

(54) APPARATUS FOR PREVENTING REVERSE FLOW IN DRAINAGE

(75) Inventor: Jong Sun Kim, A-502 Joongang Ryonrib, 197-2, Wonrni 2-dong, Wonmi-Ku, Buchon City, Kyonggi-do 420-112 (KR)

(73) Assignee: Jong Sun Kim, Buchon (KR)

( * ) Notice: Subject to any disclaimer, the term of this patent is extended or adjusted under 35 U.S.C. 154(b) by 0 days.

(21) Appl. No.: 09/530,830

(22) PCT Filed: Apr. 16, 1999

(86) PCT No.: PCT/KR99/00182

§ 371 (c)(1),
(2), (4) Date: Jul. 14, 2000

(87) PCT Pub. No.: WO00/14345

PCT Pub. Date: Mar. 16, 2000

(30) Foreign Application Priority Data

Sep. 3, 1998 (KR) ..... 1998-36371

(51) Int. Cl.[7] ..... F16K 43/00

(52) U.S. Cl. ..... 137/1; 137/192; 137/202; 137/362; 251/250

(58) Field of Search ..... 137/192, 202, 137/362, 433, 398, 446, 1; 251/250

(56) References Cited

U.S. PATENT DOCUMENTS 719,447 A * 2/1903 Fabian
1,063,807 A * 6/1913 Kullberg
1,920,062 A * 7/1933 Casani
2,074,701 A * 3/1937 Lohmolder ..... 251/250
3,107,687 A * 10/1963 Howe ..... 137/362
5,201,340 A * 4/1993 Teepe ..... 137/315
5,419,359 A 5/1995 Kor

* cited by examiner

*Primary Examiner*—A. Michael Chambers

(57) ABSTRACT

An apparatus for preventing reverse flows in a drainage is disclosed. In this apparatus, a floating device (41) and a reverse flow preventing device (54) act mutually in opposite directions owing to the floating force and the water pressure, and thus the bottom of the round body (20) of the apparatus is automatically opened and closed, so that the drainage can efficiently work, and the waste water and the draining water with foul odors can be prevented from flowing reversely. The apparatus for preventing reverse flows of waste water according to the present invention includes a round body (20) to be installed in a drain hole (60). A guide member (30) is installed on a second filtering net (25) of the top of the round body (20), and has a guide (31) at the center of it. An openable/closable device actuating member (40) is insertingly installed on the guide member (30), for moving up and down along the guide (31) owing to the floating force and the self-gravity. An openable/closable member (50) is installed on the guide member (30), for causing an air-tight sealing part to be opened and closed by being oppositely interlocked to the openable/closable device actuating member (40).

20 Claims, 12 Drawing Sheets

Prior Art

Prior Art

APPARATUS FOR PREVENTING REVERSE FLOW IN DRAINAGE

FIELD OF TEE INVENTION

The present invention relates to an apparatus for preventing reverse flows in a drainage. More specifically, the present invention relates to an apparatus for preventing reverse flows in a drainage, in which a floating device and a reverse flow preventing device act mutually in opposite directions owing to the floating force and the water pressure, and thus the bottom of the body of the apparatus is automatically opened and closed, so that the drainage can efficiently work, and the waste water with foul odors can be prevented from flowing out reversely.

BACKGROUND OF THE INVENTION

FIGS. 1 and 2 illustrate a conventional drainage reverse flow preventing apparatus 10. In this apparatus 10, a filtering device 12 is fixed on the top of a cylindrical tube 11, and an annular engaging step 13 projects from the lower inner circumference of the cylindrical tube 11. A protuberance 14 is formed under the annular step 13.

A shaft 15 pass through the protuberance 14, and a damper 16 is movably secured to the shaft 15. Further, there is installed a torsion spring 17 between the inner wall of the cylindrical tube 11 and the bottom of the damper 16.

In the conventional drainage reverse flow preventing apparatus 10 constituted as above, when waste water or drainage water does not flow within the cylindrical tube 11, the damper 16 keeps contacting to the annular step 13. That is, the damper 16 is kept closed. On the other hand, when waste water or drainage water flows through the cylindrical tube 11, the damper 16 departs from the annular step 13 so as for the damper 16 to be opened.

In this conventional apparatus 10, however,if the torsion spring 17 loses its elasticity after a long use or due to corrosion, then reverse flows cannot be prevented. Moreover, in this conventional apparatus, the closing of the damper 16 depends only on the force of the torsion spring 17, and therefore, the sealing between the damper 16 and the annular step 13 is mostly insufficient, with the result that the reverse flow of foul odors cannot be prevented.

Besides the above described conventional apparatus, there are various other apparatuses for preventing reverse flows of foul odors and waste water. However, they are not capable of serving as the apparatus for preventing foul odors and waste water simultaneously, but serves only a single function. Further, even this single function cannot be performed perfectly, thereby failing the originally intended purpose.

The flow directions of the waste water and the reversely flowing water and foul odors are directly opposite, and therefore, a strong reliability has to be ensured. Such a reliability can be provided through a complicated structure, however, a high cost should be accompanied. Further, such a complicated structure is subjected to a clogging by food stuffs and other foreign materials, with the result that the apparatus loses the intended functions.

SUMMARY OF THE INVENTION

The present invention is intended to overcome the above described disadvantages of the conventional techniques.

Therefore it is an object of the present invention to provide an apparatus for preventing reverse flows in a drainage, in which when draining waste water, a openable/closable plate descends owing to the rise of a floating device by the incoming waste water to open an air-tight sealing part so as to drain waste water efficiently, and when waste water does not flow, the floating device descends owing to the self-gravity, and the openable/closable plate ascends to close the air-tight sealing part so as to prevent the reverse flow of various foul odors. Particularly, in the raining seasons, the reverse flow of the draining water can be prevented, thereby avoiding flooding.

In achieving the above object, the apparatus for preventing reverse flows of waste water according to the present invention includes: a round body to be installed in a drain hole; a guide member installed on a second filtering net of the top of the round body, and having a guide at the center of it; an openable/closable device actuating member insertingly installed on the guide member, for moving up and down along the guide owing to a floating force and a self-gravity; and an openable/closable member installed on the guide member, for causing an air-tight sealing part to be opened and closed by being oppositely interlocked to the openable/closable device actuating member.

The round body includes: an inner body having the air-tight sealing part at a lower portion thereof; and an outer body having a flange at a lower portion thereof, the inner and outer bodies being detachably coupled together.

The guide member includes: a guide having a pair of pinions in the interior thereof, and installed at the center of the second filtering net; and a pair of guide grooves formed in both sides of the guide.

The openable/closable device actuating member includes: a floating device having a through-hole at the center of it so as for the floating device to move up and down along the guide; a weight provided in the interior of the floating device; and racks formed on the lower portion of the through hole.

The openable/closable member includes: a movable bar having racks at its upper portion, and having a securing part at a lower portion of it; and a reverse flow preventing device having an openable/closable plate and having an elastic member installed thereon, the openable/closable plate and the reverse flow preventing device being detachably coupled together.

In another embodiment of the present invention, the apparatus for preventing reverse flows in a drainage according to the present invention includes: a round body to be installed in a drain hole; a guide member installed within the round body, and having a guide at the center of it; an openable/closable device actuating member installed on the top of the guide member, for moving up and down along the guide owing to the floating force and the self-gravity; and an openable/closable member installed under the guide member, for causing a lower portion of the round body to be opened and closed by being oppositely interlocked to the openable/closable device actuating member.

The guide member includes: a guide formed at the center of it with pinions installed in the interior of the guide; a securing part having at its bottom a supporting device for supporting the guide; and a water draining part formed within the securing part.

The openable/closable device actuating member includes: a floating device having a weight provided in the interior of it, and having a guide accommodating part at the center of the inside of it; and a movable bar having racks formed on the lower portion of it, and having a securing part on the upper portion of it.

The openable/closable member includes: a passive body having racks on the inside of it, and having guide grooves on the front and rear faces of it; and a reverse flow preventing device having an openable/closable plate formed at the bottom of it and having a hooking device formed on the upper portion of it, the openable/closable plate and the reverse flow preventing device being detachably coupled together.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENTS

Figure 1:
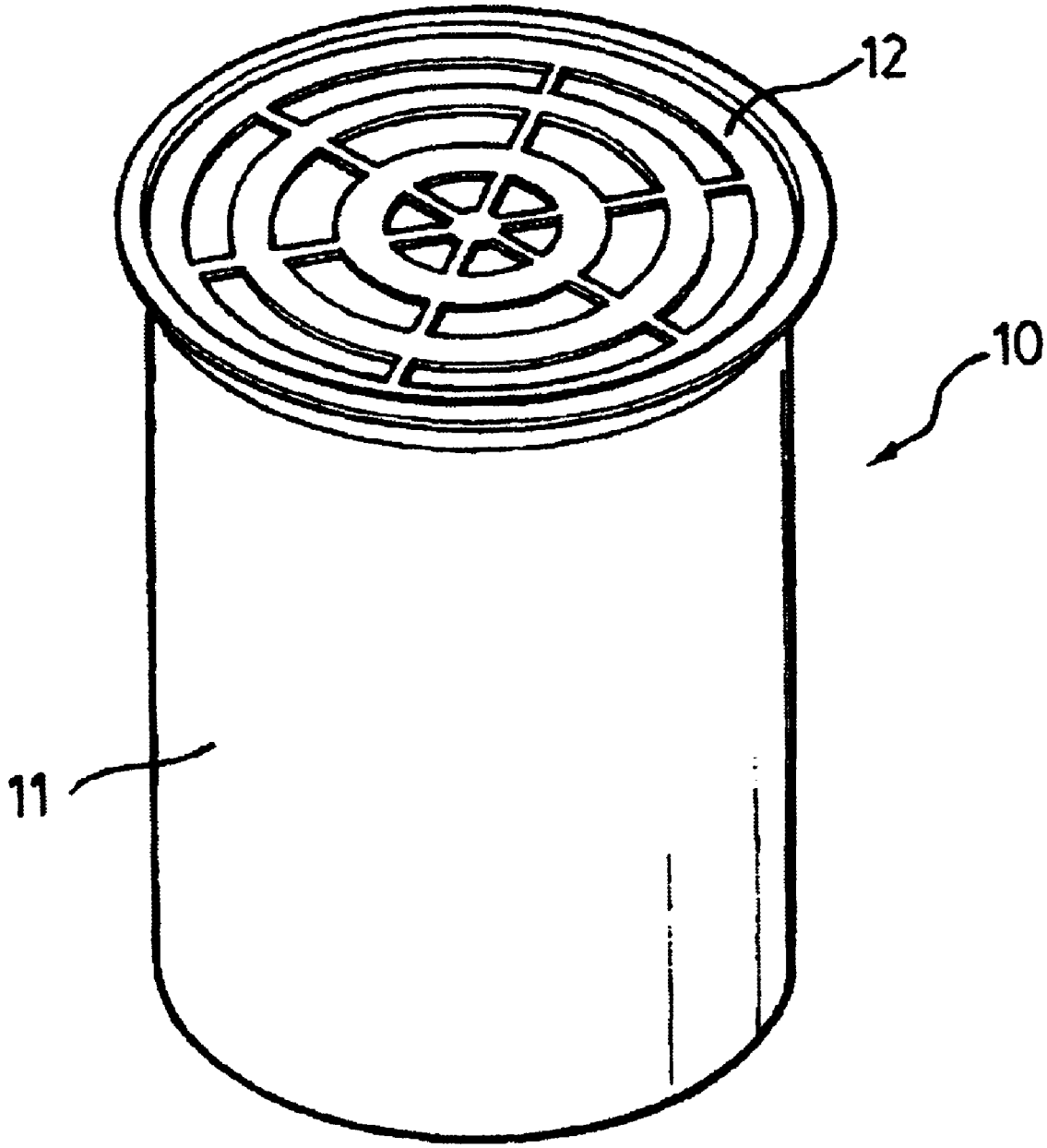
FIG. 1 is a perspective view of the conventional drainage reverse flow preventing apparatus.
Figure 2:
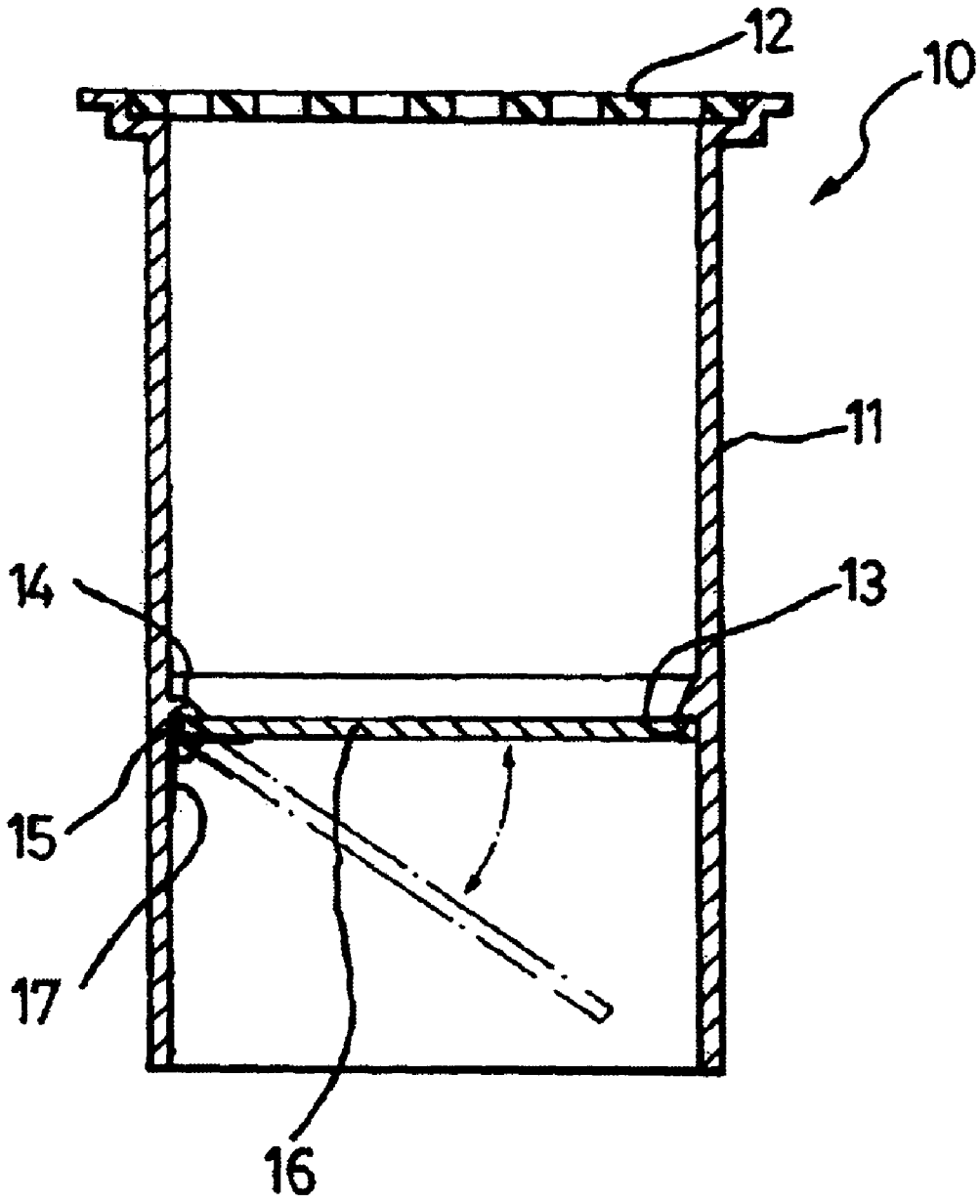
FIG. 2 is a sectional view showing the conventional apparatus installed in a draining hole.
Figure 3:
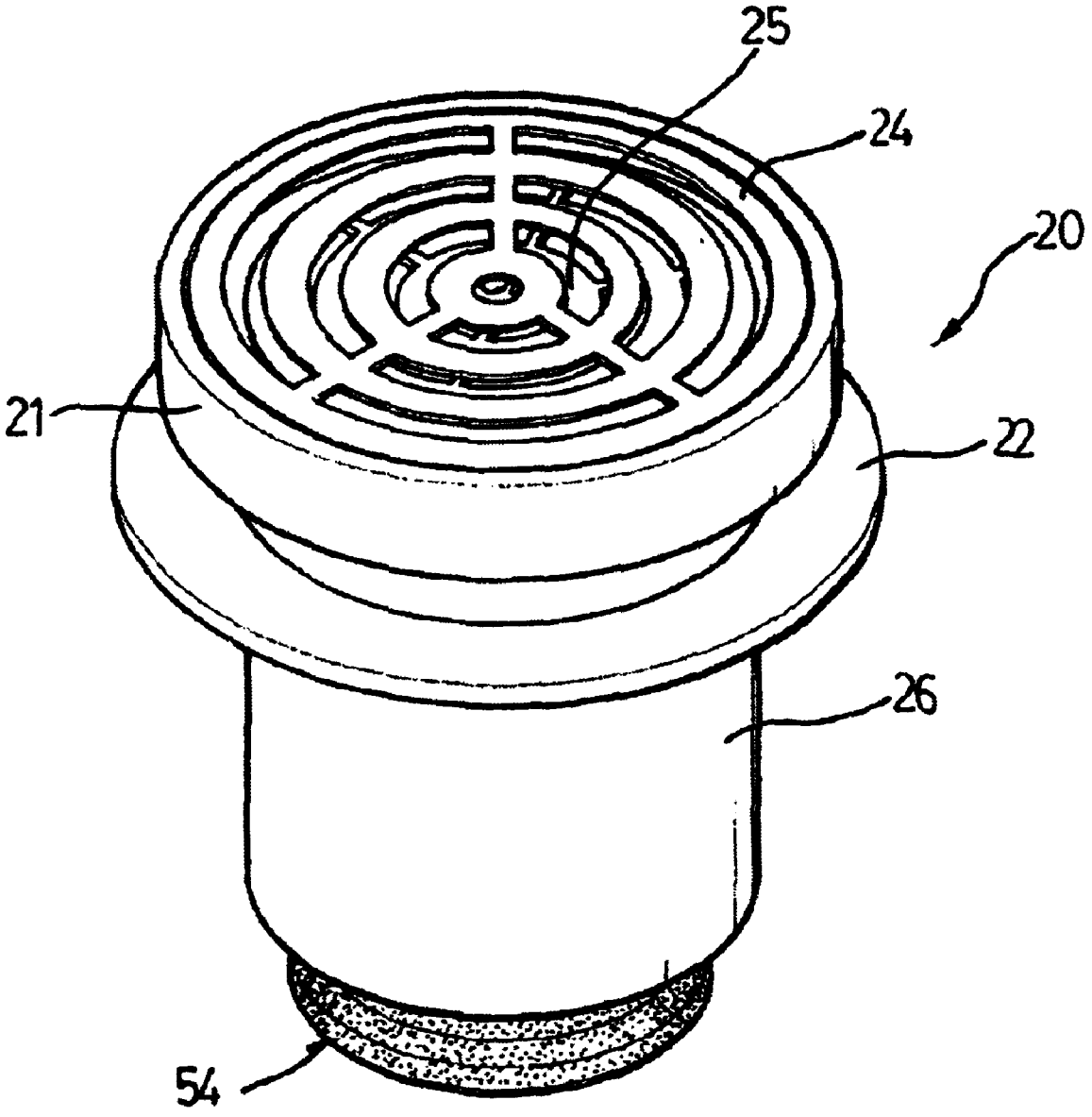
FIG. 3 is a perspective view of the drainage reverse flow preventing apparatus according to the present invention, showing the state of a normal draining.
Figure 4:
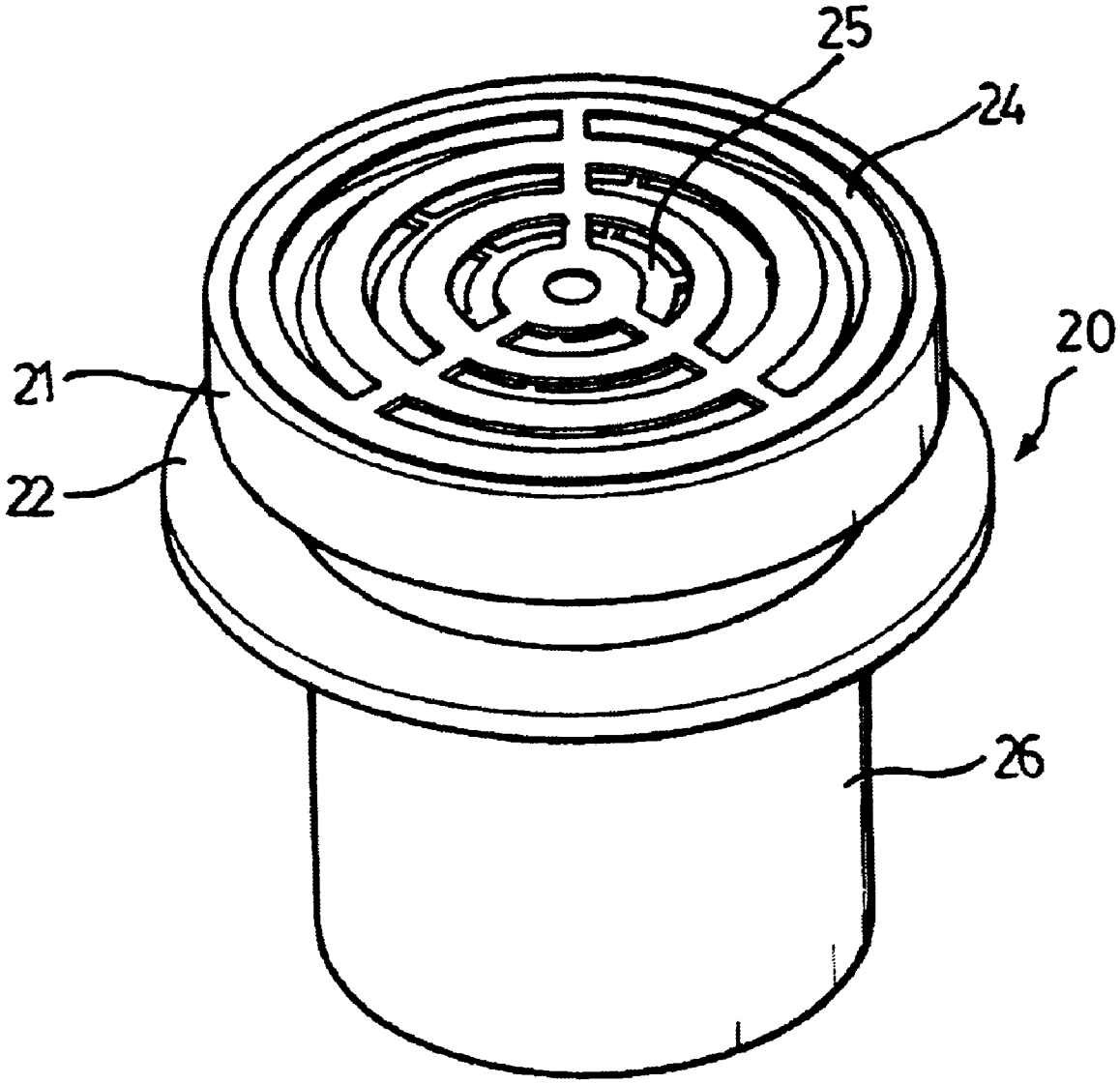
FIG. 4 is a perspective view of the drainage reverse flow preventing apparatus according to the present invention, showing the state of a reverse flow prevention.
Figure 5:
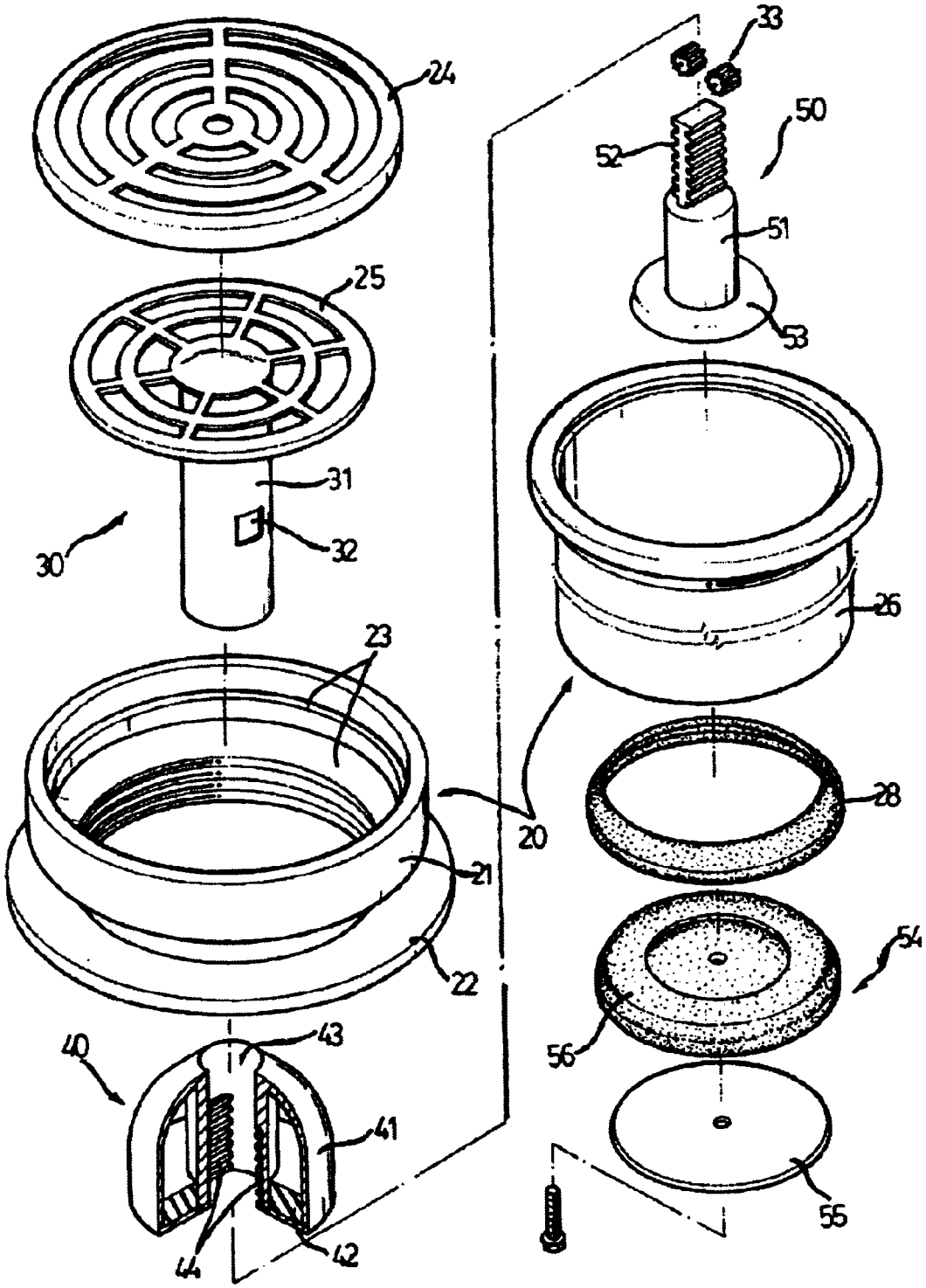
FIG. 5 is an exploded perspective view showing the drainage reverse flow preventing apparatus according to the present invention.
Figure 6:
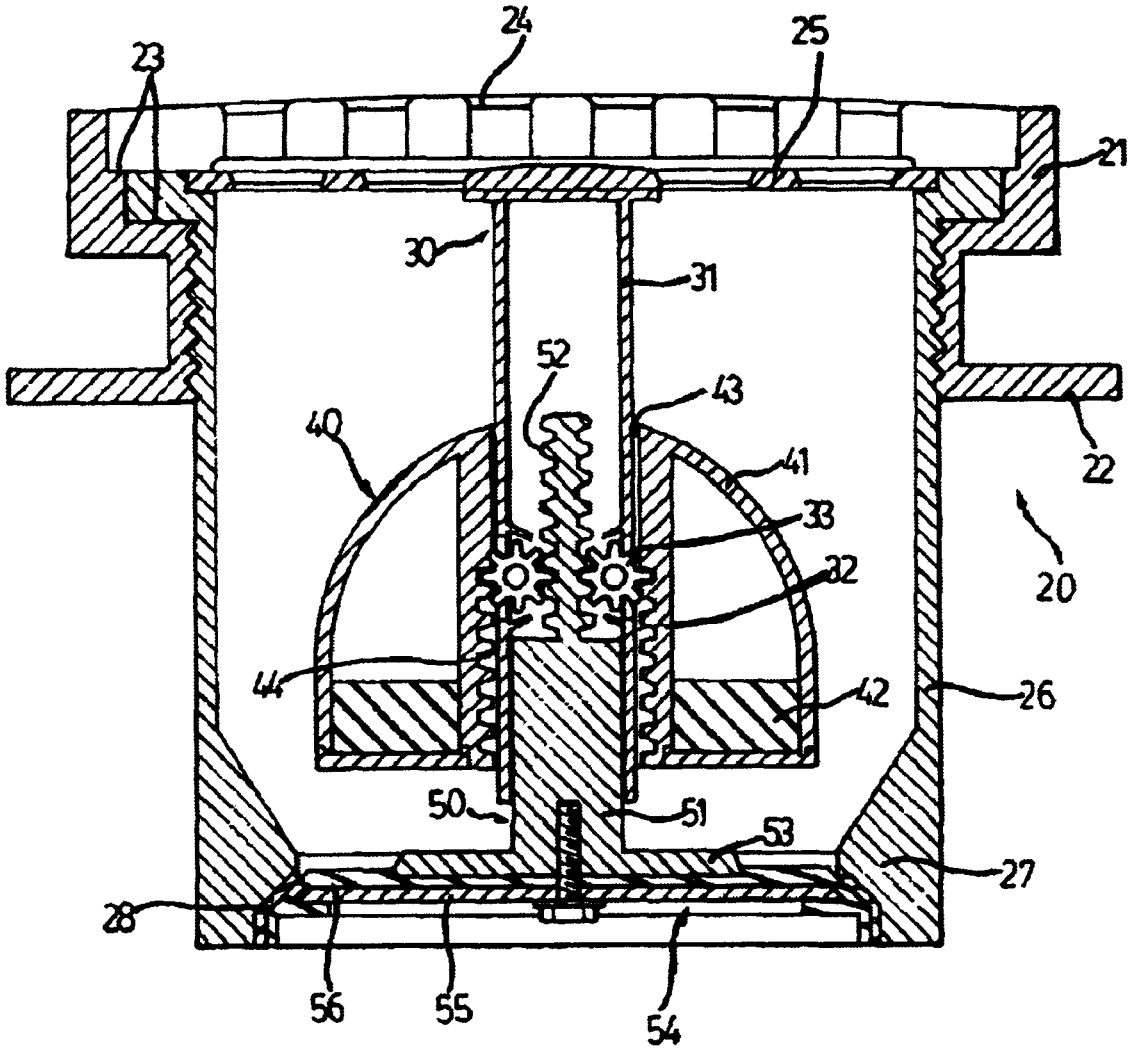
FIG. 6 is a sectional view of the apparatus of FIG. 5.
Figure 7A:
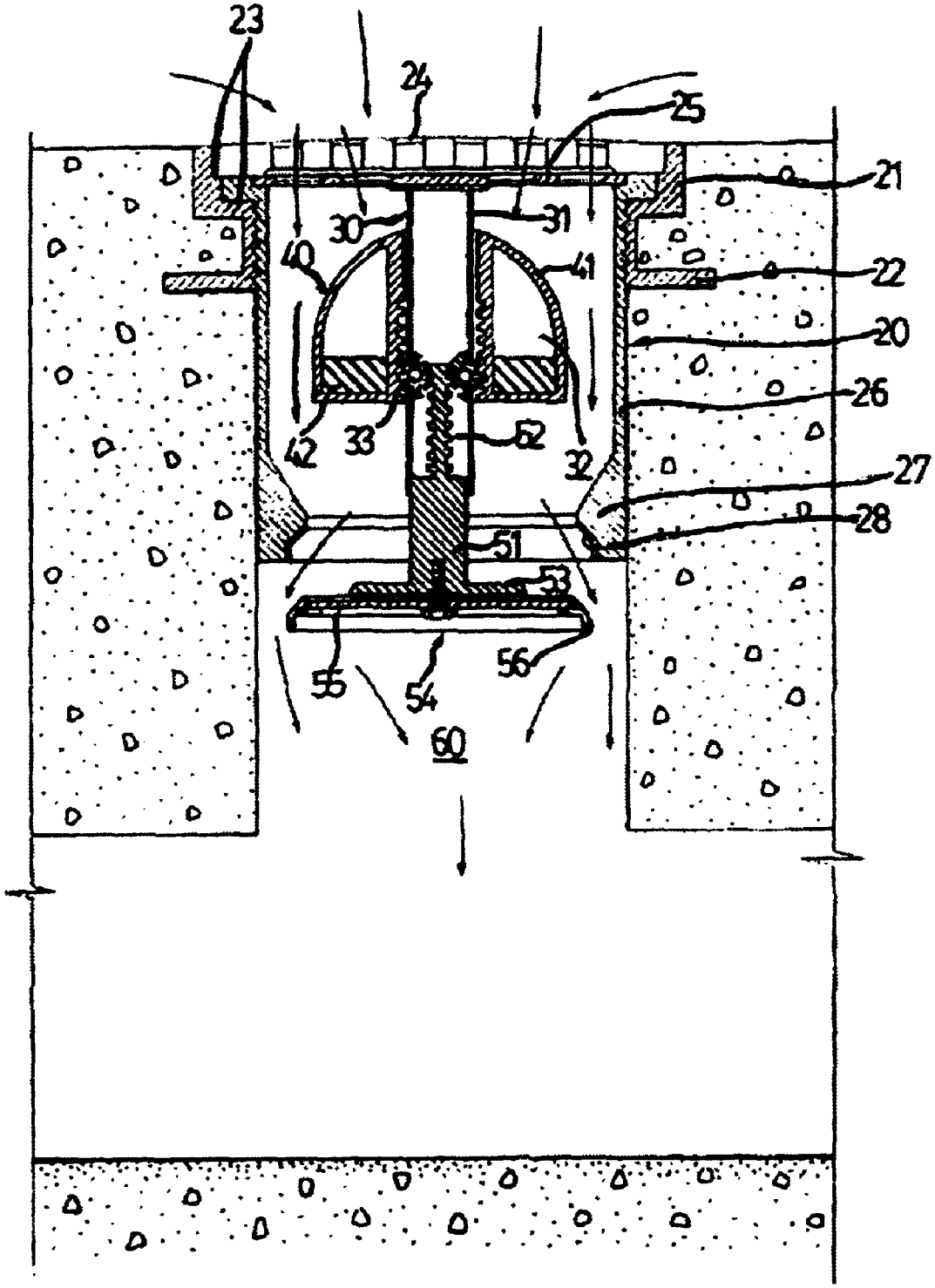
FIGS. 7*a* to 7*b* are sectional views showing the reverse flow preventing action in the apparatus of the present invention.
Figure 7B:
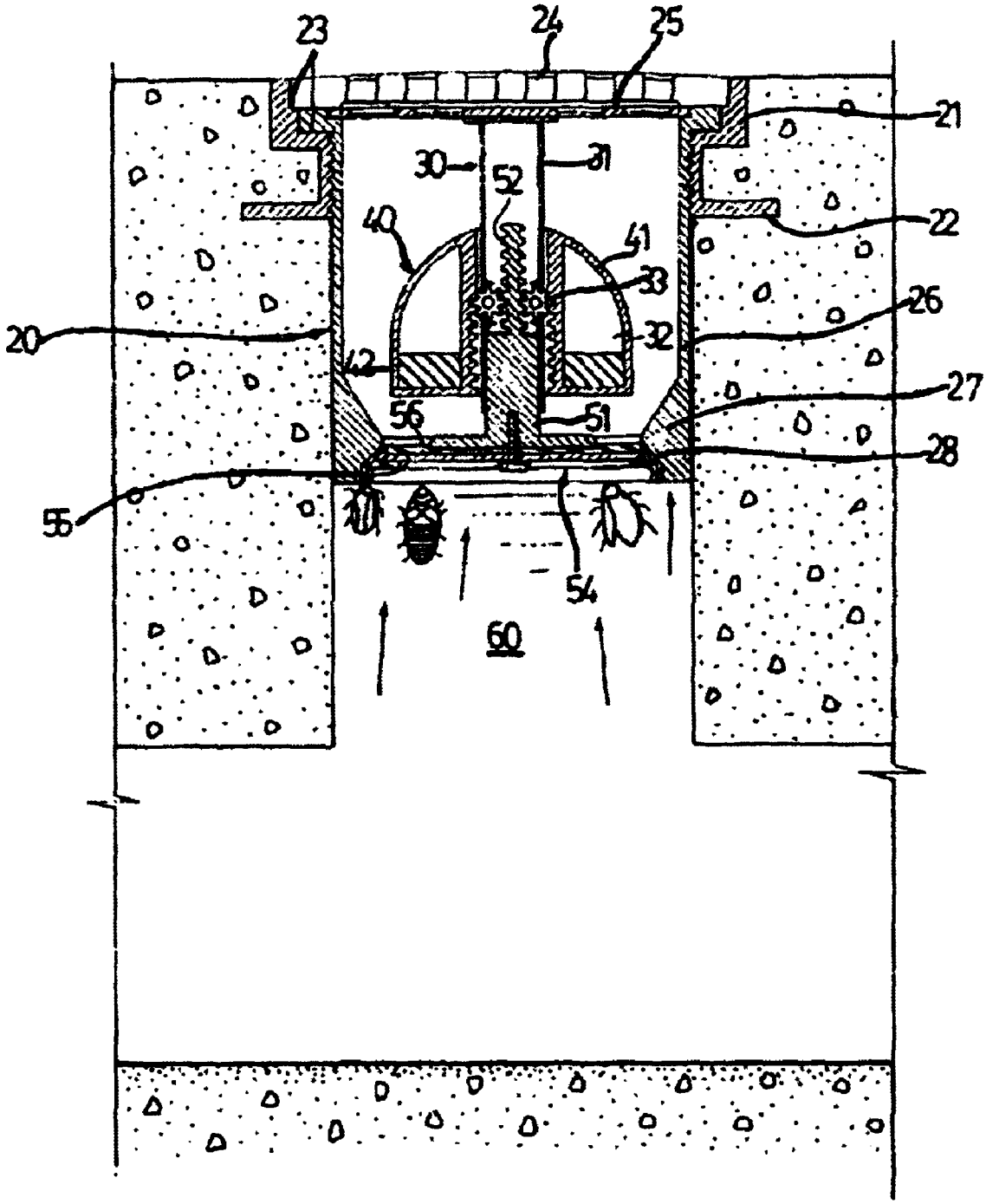

FIG. 5 is an exploded perspective view showing the drainage reverse flow preventing apparatus according to the present invention. FIG. 6 is a sectional view of the apparatus of FIG. 5. FIGS. 7*a* to 7*b* are sectional views showing the reverse flow preventing action in the apparatus of the present invention.

A barrel shaped round body 20 which is to be installed in a draining bole 60 includes an inner body 26. The inner body 26 includes: an air-tight sealing part 27 projecting inward from the lower portion of it and a threaded part formed on the upper portion of it. An elastic member 28 is installed under the air-tight sealing part 27.

The inner body 26 is coupled with an outer body 21. The outer body 21 includes: a flange 22 extending outward; a threaded part formed on the inside thereof; and steps 23 for accommodating first and second filtering nets 24 and 25.

The inner and outer bodies 26 and 21 are threadably coupled together, and therefore, they are detachable from each other.

A guide member 30 is installed on the second filtering net 25, and the member 30 includes: a guide 31 having a cylindrical shape to guide grooves 32 formed on the cylindrical wall of the guide 31; and a pair of pinions 33 installed within the guide 31.

An openable/closable device actuating member 40, which is inserted into the guide 31 to move up and down, includes a floating device 41 to ascend owing to the floating force or to descend owing to the self-gravity. The floating device 41 has a through-hole 43 for accommodating the guide 31, and racks 44 are formed on the lower portion of the through hole 43, for being coupled with the pinions 33. Further, a weight 42 is formed within the floating device 41.

An openable/closable member 50 is partly inserted into the guide 31. In the member 50, racks 52 are formed to be coupled with the pinions 33, and a movable bar 51 is formed under the racks. 52, while a securing part 53 is formed under the movable bar 51. A openable/closable plate 55 is attached to the bottom of the securing part 53, and the plate 55 is a member of a reverse flow preventing device 54.

Thus in the openable/closable member 50, the securing part 53 and the reverse flow preventing device 54 are detachably coupled by means of bolts and the like.

Now another embodiment of the drainage reverse flow preventing apparatus according to the present invention will be described.

Figure 8:
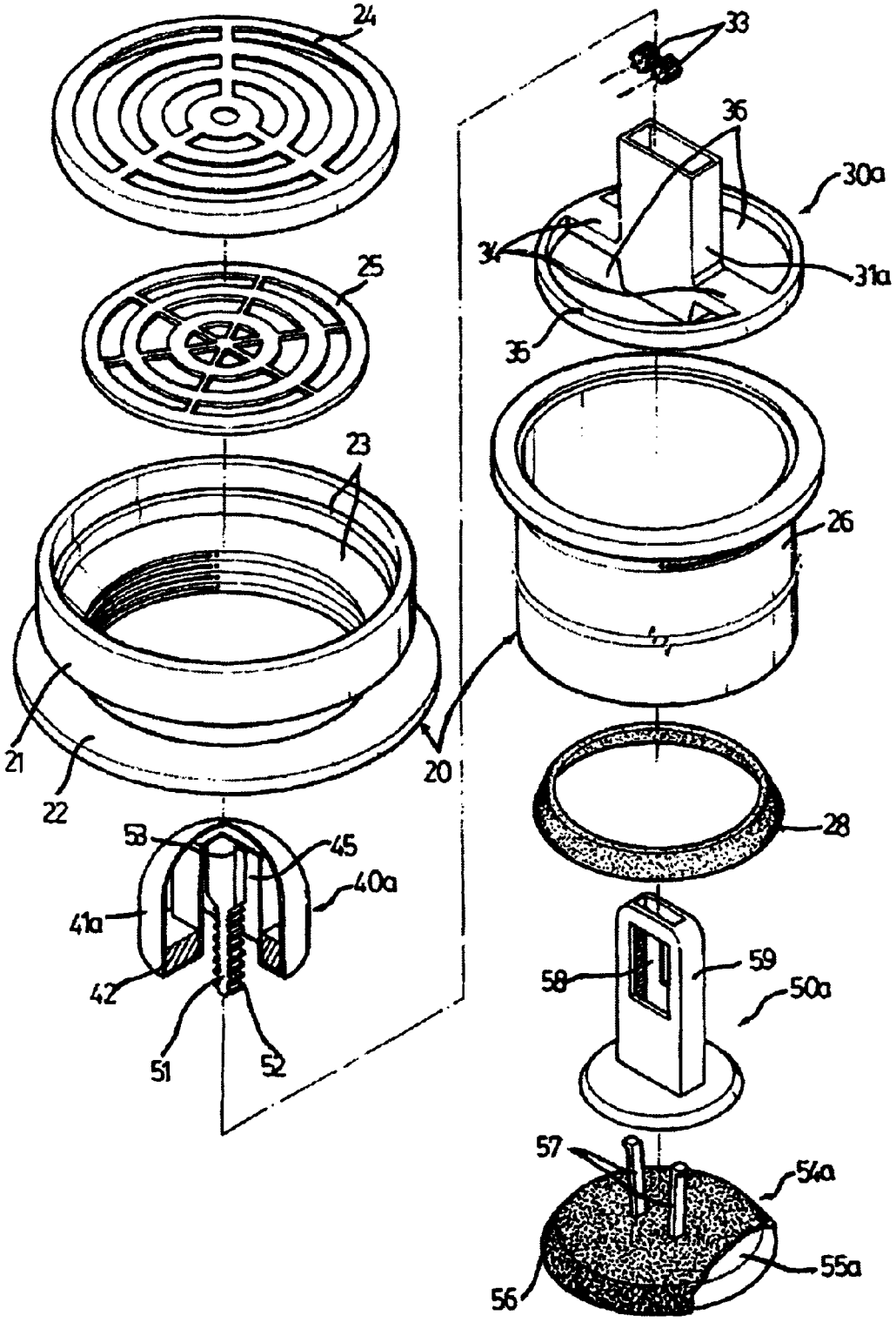
FIG. 8 is an exploded perspective view showing another embodiment of the drainage reverse flow preventing apparatus according to the present invention.
Figure 9:
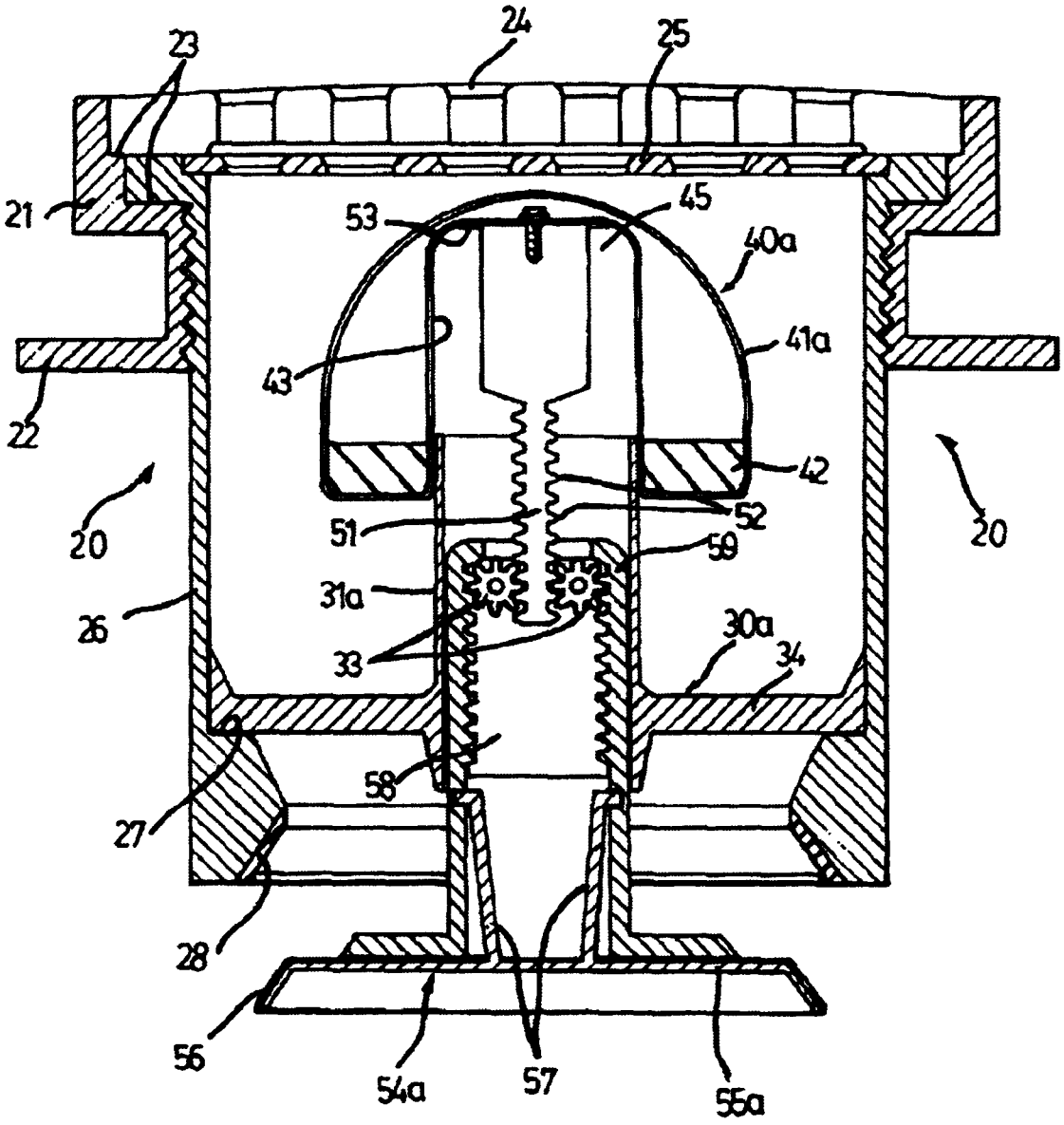
FIG. 9 is a sectional view showing the assembled state of the drainage reverse flow preventing apparatus of FIG. 8.
Figure 10A:
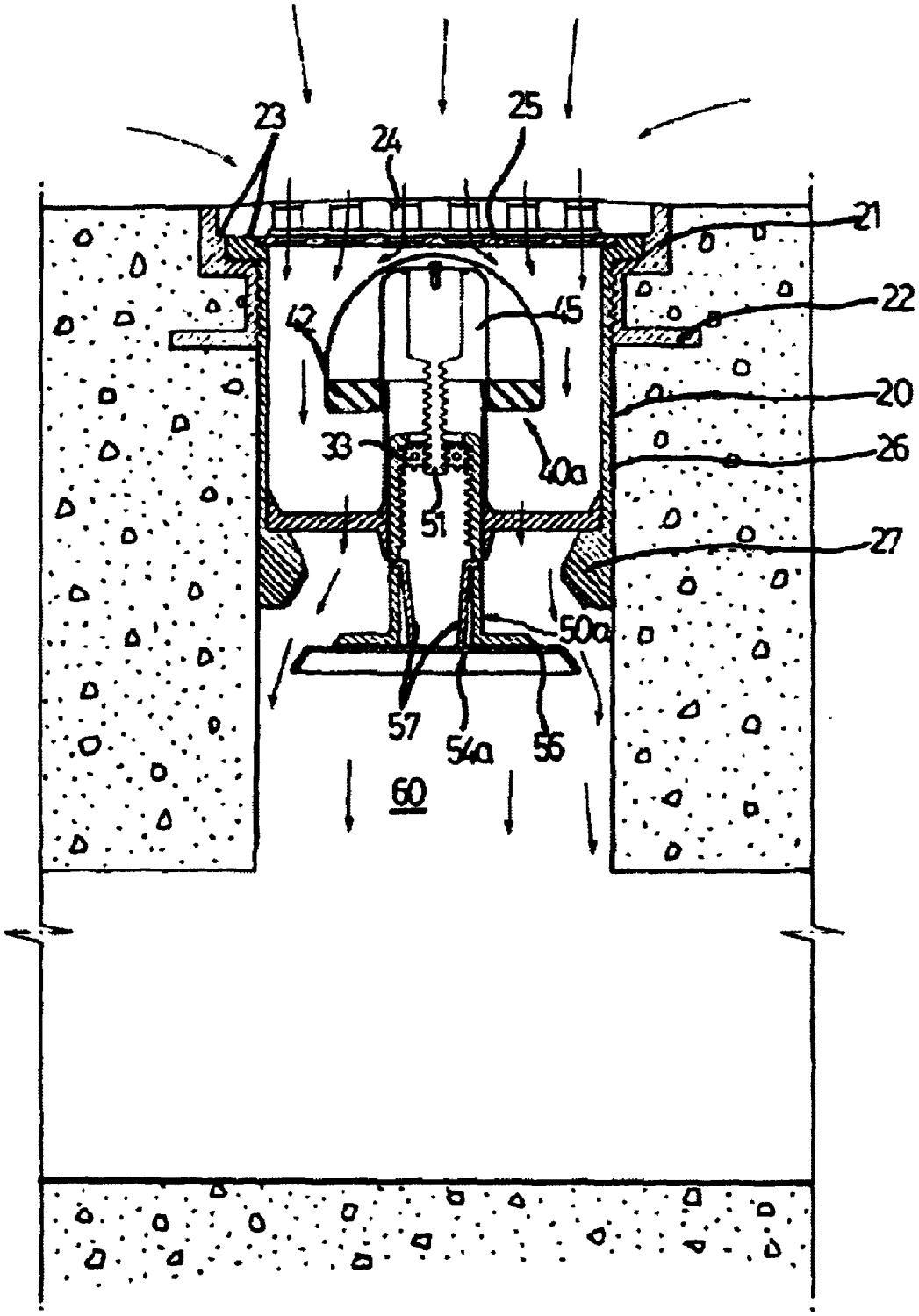
FIGS. 10*a* and 10*b* are sectional views showing the reverse flow preventing action in the apparatus according to the present invention.
Figure 10B:
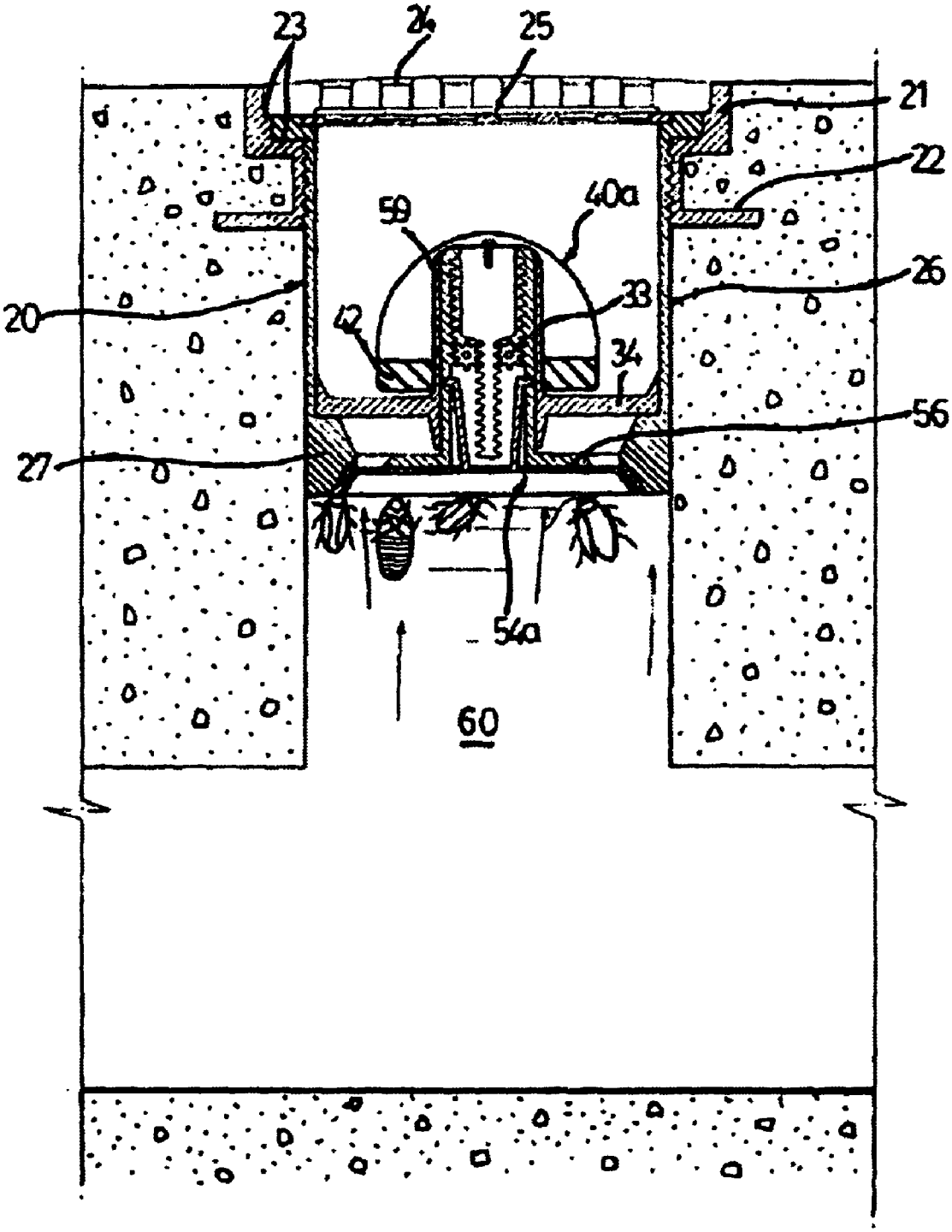

FIG. 8 is an exploded perspective view showing another embodiment of the drainage reverse flow preventing apparatus according to the present invention. FIG. 9 is a sectional view showing the assembled state of the drainage reverse flow preventing apparatus of FIG. 8. FIGS. 10*a* and 10*b* are sectional views showing the reverse flow preventing action in the apparatus according to the present invention.

The round body 20 includes an outer body 21 and an inner body 26. The outer body 21 has a flange 22 on the bottom of it, while the inner body 26 includes a threaded part. The outer and inner bodies 21 and 26 are threadably coupled together. The outer body 21 has steps 23 to accommodate first and second filtering nets 24 and 25. Thus the filtering is carried out twice, and the outer and inner bodies 21 and 26 are detachable from each other.

Further, the inner body 26 includes: an air-tight sealing part 27 on the lower portion of it; and a setting part 29 for setting a guide member 30*a*. An elastic member 28 is attached on the bottom of the inner body 26 to enhance the sealing.

The guide member 30*a* is placed on the 3setting part 29 of the inner body 26. The member 30*a* includes a guide 31*a* extending vertically, and the guide 31*a* has a hollow interior.

Further, the guide member 30*a* includes a round securing part 35, and a supporting part 34 integrally links the guide 31*a* to the securing part 35.

Between the securing part 35 and the supporting part 34, there are formed draining holes 36 for efficiently draining waste water. Within the guide 31*a*, there are installed pinions 33 which are rotatable forward and reverse.

An openable/closable device actuating member 40*a* includes a floating device 41*a* which ascends by the floating force and descends by the self-gravity. The floating device 41*a* accommodates the guide 31*a* by having a guide accommodating part 45.

A weight 42 is press-fitted to the floating device 41*a*. A securing part 53 is formed to be fastened to the guide accommodating part 45. Under the securing part 53, there is formed a movable bar 51 on which there-are formed racks 52 to be moved up and down depending on the revolution direction of the pinions 33.

An openable/closable member 50*a* opens and closes the air-tight sealing part 27. The member 50*a* is accommodated within the guide 31*a* to slide up and down. The member 50*a* includes: racks to be meshed with the pinions 33; a pair of slots to be engaged with the hooking devices 57; and a passive body 59 having guide grooves 58 with the same size to each other.

Owing to the guide grooves 58, the shafts of the pinions 33 are not impeded when the floating device 41*a* moves up and down.

An openable/closable plate 55*a* is fixed to the bottom of the passive body 59. The hooking devices 57 are formed at the center of the plate 55*a*, and the hooking devices 57 are inserted into the guide 31*a* to be engaged with the slots of the inside of the passive body 59.

An elastic member 56 is installed on the bottom of the plate 55*a* to reinforce the sealing of the air-tight sealing part 27.

Now the action of the apparatus of the present invention will be described.

The drainage reverse flow preventing apparatus according to the present invention is applicable not only to the underground draining channels, but also to the kitchen sink and the veranda draining holes. Further, the apparatus can be used at a pipe where oil flows.

The shape of the body 20 of the apparatus is not limited to the round shape, but can be varied to rectangular or any other shape depending on the shape of the draining hole 60.

First, the state of the draining of waste water through the apparatus of the present invention will be described.

As shown in FIGS. 6 and 7*a*, when water or waste water is introduced into the body 20 of the apparatus, the floating device 41 floats due to the floating forces of the introduced water.

Therefore, the pinions 33 which is meshed with the racks 44 are rotated, and therefore, the racks 52 together with the movable bar 51 descends.

Therefore, the reverse flow preventing device 54 which is fastened to the bottom of the securing part 53 departs from the air-tight sealing part 27, thereby opening the lower portion of the round body 20 In this manner, the introduced water flows efficiently through the apparatus.

When the draining is carried out in this manner, the flowing water imposes a pressure onto the reverse flow preventing device 54, and.therefore, the floating force and the water pressure are combined to completely open the reverse flow preventing device 54 from the air-tight sealing part 27.

Accordingly, the draining is more efficiently carried out.

The reason why the first and second filtering nets are installed is to filter off various foreign materials.

Now the state of preventing the reverse flow of waste water or foul odors by the apparatus of the present invention will be described in detail below.

When waste water is not introduced into the round body of the apparatus of the present invention, the floating device 41 descends owing to the self-gravity. Under this condition, owing to the racks 44 of the floating device 41, the pinions 33 of the guide 31 are rotated.

Therefore, when the floating device descends, the movable bar 51 rises owing to the racks 52 of the movable bar 51.

Accordingly, the reverse flow preventing device 54 closely contacts to the airtight sealing part 27, thereby closing the lower portion of the round body 20. Therefore, any reverse flow of waste water or foul odors is prevented.

Meanwhile, in raining seasons, if the draining holes overflow due to reverse flows through the draining conduit, the reversely flowing water pushes up the reverse flow preventing device 54, that is, lifts up the openable/closable plate 55. Therefore owing to the water pressure, the reverse flow preventing device 54 is closely contacted to the air-tight sealing part 27, thereby preventing the reverse flow.

The elastic member 28 of the air-tight sealing part 27 and the elastic member 56 of the openable/closable plate 55 enhance the contacting between the reverse flow preventing device 54 and the air-tight sealing part 27, thereby improving the sealing state and maximizing the prevention of the reverse flow.

Now the draining through the second embodiment of the apparatus of the present invention will be described in detail below.

When waste water is introduced into the round body 20 of the apparatus, the floating device 41*a* floats owing to the floating force of the introduced water Therefore, the movable bar 51 moves up together with the floating device 41*a*, while the pinions 33 are rotated because they are meshed with the racks 44.

When the pinions 33 are rotated, the passive body 59 descends owing to the racks which are meshed with the Pinions 33. As a result, the openable/closable plate 55*a* which is fixed to the passive body 59 departs from the air-tight sealing part 27, thereby opening the lower portion of the round body 20 of the apparatus. Thus the introduced water is efficiently drained into the draining hole 60.

When the introduced water flows through the round body 20 into the draining hole 60, the flowing water exerts a pressure onto the openable/closable plate 55*a*, and therefore, the floating force and the water pressure are combined to completely open the openable/closable plate 55*a* from the air-tight sealing part 27.

Therefore, the draining of the water is more efficiently carried out.

The reason why the first and second filtering nets 24 and 25 are installed in dual is to filter off various foreign materials.

Now the state of preventing the reverse flow of water or foul odors by the apparatus of the present invention will be described in detail below referring to FIG. 10*b*.

If there is no water or waste water incoming into the round body 20 of the apparatus of the present invention, then the floating device 41*a* descends owing to the self-gravity. At the same time, the movable bar 51 which is fixed to the floating device 41*a* descends together with the floating device 41*a*. Therefore, owing to the racks 52, the pinions 33 are rotated.

When the pinions 33 are rotated, the passive body 59 ascends owing to the racks which are outwardly meshed with the pinions 33. Therefore, the openable/closable plate 55*a* ascends to closely contact with the air-tight sealing part 27, thereby closing the lower portion of the round body 20.

Accordingly, any reverse flow of water or foul odors is prevented.

Meanwhile, in raining seasons, if the draining holes overflow due to reverse flows through the draining conduit, the reversely flowing water pushes up the openable/closable plate 55*a*. Therefore owing to the water pressure, the reverse flow preventing device 54 is firmly and closely contacted to the air-tight sealing part 27, thereby preventing the reverse flow.

The elastic member 28 of the air-tight sealing part 27 and the elastic member 56 of the openable/closable plate 55*a* enhance the contacting between the openable/closable plate 55*a* and the air-tight sealing part 27, thereby improving the sealing state and maximizing the prevention of the reverse flow.

According to the present invention as described above, the water draining is efficiently carried out, thereby solving the overflow problem. Further the reverse flow of the waste water or foul odors can be prevented, and therefore, the environment is prevented from being polluted or contaminated. Further, in raining seasons, the flooding due to the reverse flow through draining holes can be prevented.

What is claimed is:

1. A method of draining liquid and preventing reverse flow, the method comprising:

introducing liquid into a chamber which has a bottom closed with a bottom closer;

floating a floatable member upward by the liquid in a substantially linear direction within the chamber; and moving the bottom closer downward by the upward movement of the floatable member, thereby opening the bottom of the chamber and flowing the liquid through the bottom.

2. The method as defined in claim 1, further comprising:

continuously flowing liquid through the chamber and the open bottom; and keeping the bottom closer open during the continuous flow.

3. The method as defined in claim 1, further comprising:

settling down the floatable member within the chamber by stopping the liquid flow into the chamber; and moving the bottom closer upward by the downward movement of the floatable member, thereby closing the bottom of the chamber and preventing reverse flow of the liquid.

4. The method of claim 1, wherein the floatable member and the bottom closer are engaged with each other via a mechanism configured to operate the bottom closer such that the bottom closer closes the bottom when the floatable member is at a position closest to the bottom and such that the bottom closer opens the bottom of the body as the floatable member moves away from the bottom within the hollow body.

5. The method of claim 1, further comprising filtering the liquid before introduction thereof into the chamber.

6. The method of claim 1, further comprising guiding the floating member, while floating, so as to move the floating member in a substantially vertical direction.

7. A drain apparatus, comprising:

a hollow body having an open top, an open bottom and a side wall;

a floatable member located within the hollow body, the floatable member having freedom of movement in a substantially linear direction within the hollow body;

a bottom closer configured to close the open bottom of the hollow body; and a mechanism engaging the floatable member and the bottom closer, wherein the mechanism is configured to operate the bottom closer such that the bottom closer closes the bottom when the floatable member is at a position farthest from the top and such that the bottom closer opens the bottom of the body as the floatable member moves toward the top within the hollow body.

8. The drain apparatus as defined in claim 7, wherein the floatable number has a weight so as to settle down at its lowest position if it were not for a floating force.

9. The drain apparatus as defined in claim 7, further comprising at least one filtering net placed on the open top of the hollow body.

10. The drain apparatus as defined in claim 7, further comprising a sealing around the open bottom of the body.

11. The drain apparatus as defined in claim 7, wherein the mechanism is configured such that the bottom closer moves away from the top and opens the bottom of the hollow body as the floating member moves toward the top.

12. The drain apparatus as defined in claim 7, wherein the mechanism comprises a pinion and a rack engaged with the pinion.

13. The drain apparatus of claim 7, further comprising an outer hollow body configured to be installed in a drain hole, wherein the outer hollow body is further configured to engage with the side wall of the hollow body.

14. The drain apparatus of claim 7, wherein the hollow body is cylindrical or rectangular.

15. The drain apparatus of claim 7, wherein the direction of the movement of the floatable member is substantially vertical when the body is installed in a drain hole.

16. The drain apparatus of claim 7, wherein the hollow body has a longitudinal direction extending between the top and bottom, and wherein the direction of the movement of the floatable member is substantially parallel to the longitudinal direction.

17. A drain apparatus, comprising:

a hollow body having an open top, an open bottom and a side wall;

a floatable member located within the hollow body, the floatable member having freedom of movement in a direction within the hollow body;

a bottom closer configured to close the open bottom of the hollow body; and a mechanism engaging the floatable member and the bottom closer, wherein the mechanism is configured to operate the bottom closer such that the bottom closer closes the bottom when the floatable member is at a position farthest from the top and such that the bottom closer opens the bottom of the body as the floatable member moves toward the top within the hollow body, wherein the mechanism comprises a pinion and a rack engaged with the pinion, wherein the pinion is engaged with teeth of the floating member, and the rack is connected to the bottom closer, and wherein as the floating member moves toward the top or the bottom, the pinion rotates, and then the rack engaged with the pinion moves away from or toward the bottom of the body, whereby the bottom closer closes or opens the bottom of the body.

18. A drain apparatus, comprising:

a hollow body having an open top, an open bottom and a side wall;

a floatable member located within the hollow body, the floatable member having freedom of movement in a direction within the hollow body;

a bottom closer configured to close the open bottom of the hollow body; and a mechanism engaging the floatable member and the bottom closer, wherein the mechanism is configured to operate the bottom closer such that the bottom closer closes the bottom when the floatable member is at a position farthest from the top and such that the bottom closer opens the bottom of the body as the floatable member moves toward the top within the hollow body wherein the mechanism comprises a pinion and a rack engaged with the pinion, wherein the pinion is engaged with teeth connected to the bottom closer and the rack is connected to the floating member, and wherein as the floating member moves toward the top or the bottom, the rack moves toward the top or the bottom, which makes the pinion rotate, and then the bottom closer engaged with the pinion via the teeth moves away from or toward the top, whereby the bottom closer closes or opens the bottom of the body.

19. A drain apparatus, comprising:

a hollow body having an open top, an open bottom and a side wall;

a floatable member located within the hollow body the floatable member having freedom of movement in a direction within the hollow body;

a bottom closer configured to close the open bottom of the hollow body;

a mechanism engaging the floatable member and the bottom closer, wherein the mechanism is configured to operate the bottom closer such that the bottom closer closes the bottom when the floatable member is at a position farthest from the top and such that the bottom closer opens the bottom of the body as the floatable member moves toward the top within the hollow body; and a guide located within the hollow body, wherein the hollow body is a cylinder having a longitudinal direction, and wherein the guide is configured to guide the movement of the floatable member in a direction that is substantially identical to the longitudinal direction.

20. The drain apparatus of claim 19, wherein the guide comprises a longitudinal structure extending in the longitudinal direction within the hollow body, wherein the floatable member comprises a mating structure with the longitudinal structure, and wherein the floatable member and guide are arranged such that the mating structure is engaged with the longitudinal structure throughout the movement of the floating member within the hollow body.

* * * * *